United States Patent [19]

MacCarthy

[11] 4,290,225

[45] Sep. 22, 1981

[54] LOOPED-STRING PULLEY-SUPPORTED YO-YO

[76] Inventor: Patrick MacCarthy, 37 Mines Park, Golden, Colo. 80401

[21] Appl. No.: 120,289

[22] Filed: Feb. 11, 1980

[51] Int. Cl.[3] ..... A63H 27/12

[52] U.S. Cl. ..... 46/61

[58] Field of Search ..... 46/61, 60, 32, 62; 273/319, 330, 332, 413, 414

[56] References Cited

U.S. PATENT DOCUMENTS

| | | | |
|---|---|---|---|
| D. 142,317 | 8/1945 | Elfmont | 46/61 UX |
| 415,896 | 11/1889 | Bradner | 248/329 |
| 2,372,680 | 4/1945 | Pitar | 46/61 |
| 2,538,120 | 1/1951 | Nakano | 46/61 |
| 3,207,508 | 9/1965 | Klemke | 46/61 X |
| 3,228,140 | 1/1966 | White | 46/61 |
| 3,256,635 | 6/1965 | Radovan | 46/61 |
| 3,263,361 | 8/1966 | Bowden | 46/61 |
| 3,362,101 | 1/1968 | Grow | 46/61 X |
| 3,858,348 | 1/1975 | Brown | 46/61 |
| 4,086,722 | 5/1978 | Brown | 46/61 |

FOREIGN PATENT DOCUMENTS

| | | | |
|---|---|---|---|
| 757917 | 1/1934 | France | 46/61 |
| 1408251 | 10/1975 | United Kingdom | 46/61 |

OTHER PUBLICATIONS

"Experimental Fun With the Yo-Yo and Other Science Projects", Renner, Al G., Dodd, Mead & Co., N.Y. TM 1979.

*Primary Examiner*—Gene Mancene
*Assistant Examiner*—Mickey Yu
*Attorney, Agent, or Firm*—Sughrue, Mion, Zinn, Macpeak & Seas

[57] ABSTRACT

A toy having combined rotational motion about a horizontal axis and a translational motion in a vertical direction. Three parallel discs are connected through their centers by a single axle. An inner disc is positioned between two outside discs leaving a gap on the axle between the inner disc and each of the outside discs. Opposite ends of a single string are attached to the axle at each of the gaps and the string is looped over a rotatably-mounted pulley. The pulley is held by a support member connected to a swivel system which is in turn connected to a ring. In order to operate the toy the user's finger is placed in the ring and an up-and-down motion is initiated. The balance of the toy during operation is facilitated by the use of a single string connected to the axle at two points, said string being looped over a support in a slidable manner.

5 Claims, 4 Drawing Figures

LOOPED-STRING PULLEY-SUPPORTED YO-YO

BACKGROUND OF THE INVENTION

1. Field of the Invention

This invention relates to the field of rotating toys. More specifically, this invention relates to a looped string pulley supported yo-yo comprised of a single string connected to an axle at its opposite ends and looped over a pulley in a slidable manner.

2. Description of the Prior Art

The prior art reveals various toys having combined rotational motion about a horizontal axis and a translational motion in a vertical direction. One type of such toy is commonly referred to as a yo-yo. This toy has also been referred to as a return top; quiz; prince of Wales'toy; bandalore; or émigrette. A conventional yo-yo consists of a single axle having two parallel positioned discs centrally connected to the axle. A string is connected to the axle between the discs at one end and is held in the user's hand at the other end. The string is wrapped around the axle by the user and then is forced downward. Upon being forced downward, the string unwinds and provides a rotational momentum to the discs. Once the string has been completely unwound, the rotational momentum of the discs continues to exist and thus causes the string to be rewound around the axle as it travels upward vertically toward the user's hand. The conventional structure of this yo-yo is disclosed within U.S. Pat. No. 3,263,361 to Bowden et al., and U.S. Pat. No. 3,256,635 to Radovan. The conventional yo-yo structure as described above has achieved tremendous success in the past as an entertaining toy. Furthermore, certain modifications of that conventional yo-yo such as that disclosed within Bowden may have achieved success as entertaining toys. However, the conventional yo-yo structure has a pronounced limitation when used by inexperienced or younger operators. The limitation is apparent to even the most casual observer and resides in the ability to maintain the balance or equilibrium of the toy during use. The inability of the inexperienced user to maintain this balance results in a wobbling motion of the yo-yo during use. The operator loses control of the yo-yo when the balance of the toy is disturbed thus causing the yo-yo to slow its rotational motion and thus lose its ability to maintain vertical translational motion.

Even though the specific problem of the inexperienced user's inability to maintain the balance of the yo-yo is apparent, the solution to the problem has not been solved until the presentation of this invention. Previous attempts at modifying the conventional yo-yo structure are disclosed within U.S. Pat. No. 3,207,508 to Klemke and U.S. Pat. No. 3,228,140 to White. These modifications may provide additional temporary balance to the horizontal stability of the axle by attaching two separate strings to the yo-yo axle at two separate points. However, the devices make no provision for the possibility of one of the strings being wound around the axle more quickly than the other, thus resulting in tilting.

A variety of modifications to conventional yo-yo structure have been developed within the prior art. These modifications include the addition of steel rings to the discs of the yo-yo. Some of the modifications have been directed towards improving the stability of the yo-yo. Other modifications to the conventional yo-yo structure do not have as their purpose the improvement of the stability of the yo-yo, but rather providing a toy having added versatility and function thus requiring greater skill and manual coordination for their operation.

Accordingly, the prior art appears to be comprised of yo-yo toys of conventional structure, conventional yo-yos with slight aesthetic modifications, yo-yos whose structure has been modified with the intent of providing improved stability, and yo-yos whose conventional structure has been modified with the intent of providing additional versatility and function. The structure of the present invention removes it from being classified strictly as a conventional yo-yo. Although the present invention may be modified aesthetically to produce light and sound effects, the structural differences between the present invention and a conventional yo-yo indicate that the present invention is more than a mere modification of conventional structure intended to bring out merely aesthetic differences over a conventional yo-yo. Although the structure of the present invention was intended to and did result in a toy having increased stability over a conventional yo-yo structure, the present invention also is capable of certain increased versatility of function over conventional yo-yo toys.

As an indication of the enhanced stability and ease of operation inherent in the yo-yo of the present invention, the following illustrative examples may be given: After minimal practice, most children above the age of 6 years can readily operate the yo-yo for extended periods of time. Older children can easily maintain the device in operation for very long periods. The yo-yo presented herein can be readily operated while the user has his eyes closed.

As an indication of the increased versatility of the yo-yo presented herein, the user will find that it is a simple matter to operate the yo-yo by suspending it from one's mouth or by standing on a table or elevated platform, and suspending it from one's foot. The yo-yo can also be readily operated by suspending it from a considerable height of twenty feet or more and allowing it to oscillate from that height to the ground and back. Thus, the enhanced stability results in greater versatility of function. Since the enhanced stability is generally lacking in a conventional yo-yo structure, and the existing modifications thereof, the prior art yo-yos do not possess the stability or versatility of the present invention.

Other features inherent in the present invention are the smoothness of its motion and the gentleness of the impulse required in order to maintain its oscillatory motion. Its ease of operation and smoothness of motion make it a pleasurable toy for both young and old. Due to the stability, less concentration is required for using the present invention during normal operations than is required for operating a conventional yo-yo.

SUMMARY OF THE INVENTION

The presently claimed invention is comprised of a single axle which connects at least two parallel discs at their centers. Opposite ends of a single string are attached at separate points along the axle in between the discs. The string is looped over a support upon which the string may easily slide. In order to operate the yo-yo, the user must hold the support over which the string is looped and move that support gently up and down. The user's finger may be the support.

By attaching a single string to the axle at two points, increased stability is provided to the axle. In order to avoid problems which might result from one end of the string wrapping around the axle faster than the other end of the string, the string is looped over a slidable support. Accordingly, if one end begins winding around the axle faster than the other end, the string will slide on the support and maintain the horizontal stability of the axle.

In a preferred embodiment of the present invention, a barrier in the form of a third disc separates the two end discs as well as the two attachment points of the string ends. Furthermore, the string is looped over a pulley or grooved wheel. The pulley is rotatably mounted on a C-shaped support member which is in turn connected to a series of swivels which are attached to a holding ring. In order to operate the preferred embodiment of the present invention, the user places his finger through the ring. After winding the ends of the string around the axle, the body of the yo-yo is allowed to fall. Thereafter, gentle up and down oscillatory motion is maintained to keep the body of the yo-yo rotating and thus maintaining its vertical up and down motion. If one end of the string begins to wind around the axle faster than the other end, the string may slide in the groove of the pulley and/or the pulley wheel may turn, since it is rotatably mounted on the C-shaped support.

In order to further increase the ease of operation of the present invention, a ring may be suspended just below the pulley. The ring is suspended from arms which extend downwardly from the C-shaped support member holding the pulley. The ring is smaller in diameter than the diameter of the discs comprising the yo-yo body. Accordingly, when the yo-yo rises to a point close to the pulley, it is prevented from touching the pulley by the ring. Alternatively, this ring may closely surround the pulley; this does not prevent contact between the body of the yo-yo and the pulley, but does prevent the string from being knocked off the pulley. The ease of operation of the device is further increased by the swivel system, consisting of one or more swivels, which is connected to the C-shaped support. The swivels allow the relaxation of rotational tension in the string. This prevents the two downwardly extending sections of the string from becoming intertangled.

In accordance with the above-described description of the invention, and a further description which will follow, it is the primary object of this invention to provide a toy comprised of an axle; two discs supported at their center points on said axle; a single string having its opposite ends connected to said axle at two points; and a support over which the string may be slidably looped.

Another object of the present invention is to provide a yo-yo toy that is more stable than a conventional yo-yo toy.

Another object is to develop a yo-yo which is considerably simpler to operate than a conventional yo-yo, in that less skill is required to operate it, thus making it more attractive to the novice yo-yo operator.

Still another object of the present invention is to present a yo-yo toy which is simple in design and in construction.

Another object of the invention is to present a yo-yo toy which possesses such greatly increased stability that it results in increased versatility of the function of the toy.

Another object of the invention is to provide a yo-yo which is comprised of an axle; two discs supported at their center points on said axle; a third disc supported on said axle at its center point and separating said two discs; a single string attached to said axle on either side of said separating disc; a rotatably-mounted grooved wheel over which said string is looped.

These and other objects and advantages of the present invention will become apparent to those skilled in the art upon reading the details of construction and use as more fully set forth below, reference being made to the accompanying drawings forming a part thereof wherein like numerals refer to like parts throughout.

DESCRIPTION OF THE PREFERRED EMBODIMENTS

Before the present single looped string pulley supported yo-yo is described, it is to be understood that this invention is not limited to the particular arrangement of parts shown, as such devices may, of course, vary. It is also to be understood that the terminology used herein is for the purpose of describing particular embodiments only; it is not intended to be limiting since the scope of the present invention will be limited only by the appended claims.

Figure 1:
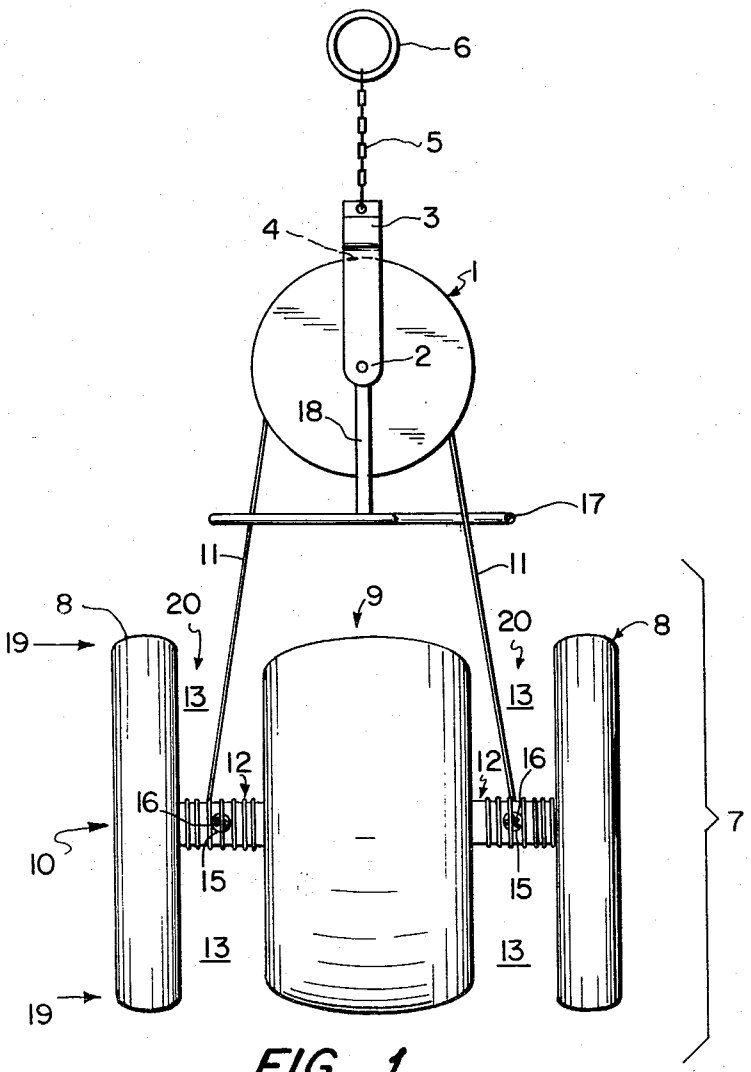
FIG. 1 is a plain front view of the present yo-yo toy.

Referring now to the drawings and to the FIG. 1 in particular which shows a plain front view of the present invention. The body of the yo-yo is referred to generally by the number 7. The body 7 is comprised of a single axle 12. The axle 12 has a pair of identical outer discs 8 positioned at their center points on the axle 12. The discs 8 are circular and are separated by a divider such as the third disc 9, also shown within FIG. 4. Although the discs 8 should be identical, the inner disc 9 may be the same or different in size from the outer discs 8. The discs may be hollow or solid, and their faces may be flat or curved.

A single string 11 has its opposite ends connected to the axle 12. The opposite ends of the string 11 are connected to the axle 12 at separate points 15. The connection points 15 are parallel holes positioned in the axle 12.

Figure 3:
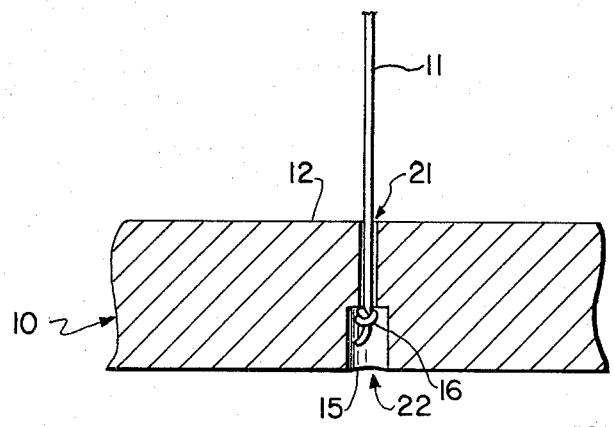
FIG. 3 is an expanded cross-sectional view of the axle shown in FIG. 1 looking in the direction of the arrows 20.

The connection points of the ends of the string are comprised of narrow bores 21 which expand to wider bores 22, as shown within FIG. 3. The end of the string 11 is forced through the narrow bore 21 and the wide bore 22 and made into a knot 16. The knot 16 can fit within the wider bore 22 but cannot slide through the narrower bore 21.

Prior to connecting both ends of the string 11 to the axle 12, the string 11 is looped over the pulley 1. After looping the string 11 over the pulley 1, both ends of the string may be secured to the axle 12. By referring to FIG. 2, it can be seen that the string 11 lies in the trough 14 of the pulley 1.

The pulley or grooved wheel 1 is rotatably supported on a C-shaped support member 3. When the string is so attached to the axle 12 and lying within the groove 14, the top center portion 4 of the string 11 is positioned between the top of the groove 14 and the support 3. The toy is balanced in this position.

One or more swivel members making up a swivel system 5 is connected to the top of the support 3. The swivel system 5 allows for rotational motion of the support 3. Attached to the other end of the swivel system 5 is a holding ring 6. The entire device may be held by the user by placing a finger through the ring 6.

Arms 18 extend downwardly from the support member 3. Supported on the ends of the arms 18 is a loop member 17. The loop 17 has a diameter smaller than the diameter of at least one of the discs 8 or the disc 9. When the yo-yo toy is in use, the loop member 17 prevents the body 7 from striking the pulley 1. Accordingly, the loop member 17 aids in preventing the string 11 from losing its position within the trough 14. Alternatively, instead of the loop 17 lying below the pulley, a loop may closely surround the pulley 1. In this case, the arms 18 extend outwardly from the C-shaped support member 3. This alternative type or location of loop does not prevent the yo-yo body 7 from striking the pulley 1, but it does prevent the string from being displaced from the pulley trough 14, even when the yo-yo body 7 rises above the level of the pulley 1.

Figure 2:
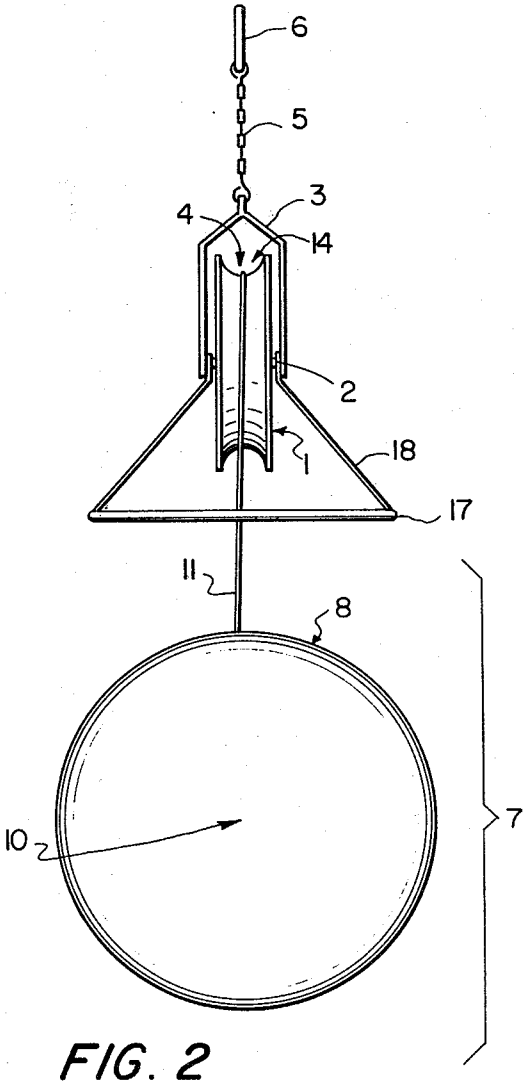
FIG. 2 is a plain side view of the present yo-yo toy looking in the direction of the arrows 19.

As shown within FIG. 2, the string 11 should lie within the center of the trough 14. The top center point 4 of the string 11 should be positioned at the uppermost portion of the pulley 1. The center portion 4 of the string 11 will naturally take this position, since the pulley 1 is rotatably mounted on the support member 3.

Figure 4:
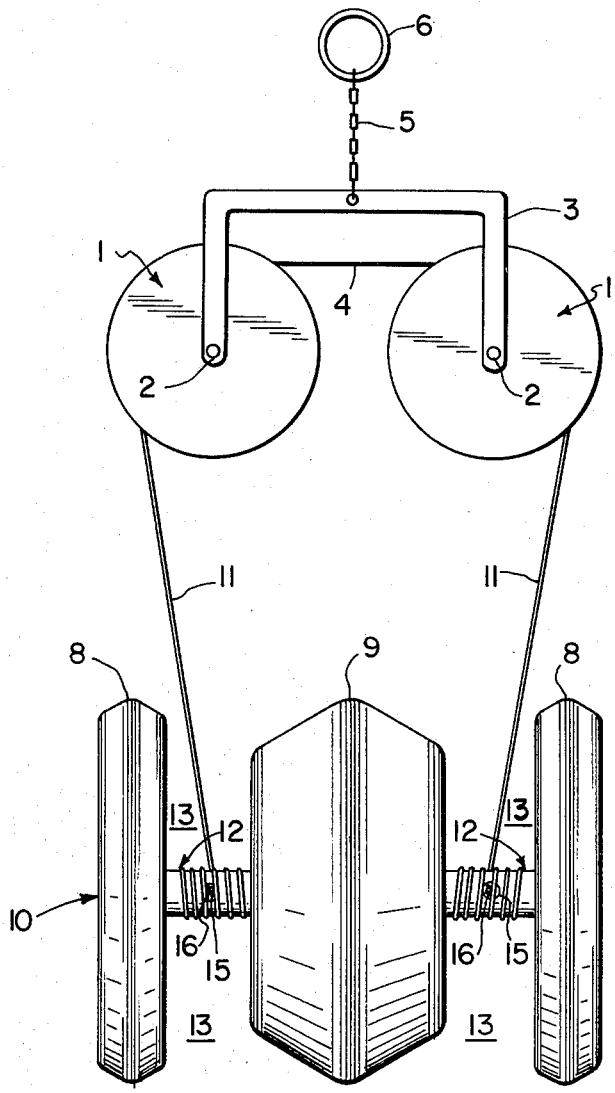
FIG. 4 is a plain front view of a second embodiment of the yo-yo toy.

As shown within FIG. 4, it is possible to utilize two or more pulleys 1 in this invention. When two pulleys are utilized, such as is shown within FIG. 4, the topmost center portion 4 of the string 11 becomes positioned between the two pulleys 1. Each pulley is rotatably mounted on its axis 2 and held by a C-shaped support member 3. The separate support members 3 are interconnected by a horizontal bar. The mid-point of this horizontal bar is then in turn connected to the swivel system 5.

It should be noted that the ends of the string 11 can be attached to the axle 12 by tying it about the axle, or by passing the string through the narrow end 21 at the positions 15 and tying the knot 16 as described above. Smoother operation of the device is obtained by attaching the string 11 to the axle 12 in the manner as shown within FIG. 3.

When the string 11 is attached to the axle 12, it can be wound around the axle. When the string has been attached in the manner as shown within FIG. 3, the string does not encounter any bump due to a knot while the yo-yo toy is being rotated. Accordingly, the string 11 smoothly wraps itself around the axle 12 on either side of the inner disc 9 between each of the outer discs 8 within the grooved portions 13. The string 11 is wound in the same direction over the two axle segments 12, for example, by twisting the body 7 of the yo-yo in one's hand or by placing the body 7 on the ground and pulling it along with the string, allowing it to roll along the surface of the ground and thus wind the string around the axle.

The ring 6 is simply a means for holding the yo-yo. The ring 6 is held in one's hand or the finger may be placed through the center of the ring. While holding the ring 6 in one hand, the body 7 is held in the other hand after the string has been wrapped around the axle 12. The operation of the toy can be initiated by letting the body 7 fall free while holding the ring 6. Thus, the initiation of the operation of the toy is analogous to the operation of a conventional yo-yo.

As the yo-yo body 7 falls under the influence of gravity, it must rotate about the horizontal axis 10, unwinding the string. The yo-yo body 7 continues spinning until no more string 11 remains wound on the axle segments 12 in the grooves 13. At this point, the body 7 of the yo-yo has developed angular momentum. The angular momentum of the body 7 causes the body 7 to continue its rotary motion, thus winding the string 11 back onto the axle 12 in the opposite direction resulting in the rising of the body 7 upward. A gentle upward impulse is applied to the string 11 via the ring 6, prior to the yo-yo reaching the bottom of the swing. This gentle upward impulse compensates for the frictional loss of energy and allows the yo-yo to rise up to its original starting position.

Typically, each narrow hole 21 is parallel to the contiguous broader hole 22. Furthermore, each of the holes 21 in the axle 12 on either side of the disc 9 are parallel to each other and have their outer extremities on the same side of the axle 12. However, the device is not inoperative if the holes are not parallel to each other. Nor is it absolutely necessary for the string 11 to be wound the same number of turns on each side of the axle 12. Any inequalities in this regard do not cause the yo-yo to depart from its horizontal axis orientation due to the presence of one or more pulleys 1. Since the string can readily slide along the groove 14 in the pulley, and since the pulley itself can rotate, the balance of the body 7 is maintained. The two unwound portions of the string 11 between the axle segments 12 and the top center portion 4 of the string 11 are automatically maintained equal at all times.

It is not essential that the width of the two grooves 13 be equal, or that the segments of the axle 12 within each of these grooves have the same diameter or even that the two string segments on opposite sides of the pulley 1 be equivalent in diameter. However, within the preferred embodiment, the above-mentioned corresponding parts are equivalent. The ability of the yo-yo to function properly even when there are inequalities between these corresponding parts serves to demonstrate the lack of precision which can be tolerated in the manufacture of the present invention. The desire to maintain these corresponding parameters equal in the preferred embodiment does not serve to demonstrate any inferiority of the present invention over previous designs. Furthermore, any inequality in the rate at which each end of the string segment 11 is retracted by the body of the yo-yo 7 due to accidental differences in the way in which the string wraps on top of itself in the two grooves 13 does not upset the horizontal alignment of the yo-yo axis 10. In general, the rate of retraction of the two string segments will not be equal due to differences in the winding patterns of the two ends of the string 11. However, even with unequal winding of the ends of the string 11, the pulley 1 maintains the horizontal balance of the yo-yo. Furthermore, it should be noted that it is not necessary that the diameter, weight or thickness of the outer discs 8 be equal to the corresponding parameters of the inner disc 9 in order to maintain the balance of the body 7.

The body of the yo-yo 7 will still rotate in balance in a satisfactory manner even if the holes 21 positioned in the grooves 13 are not parallel, or if the number of turns of the string around the axle 12 in each of the grooves 13 is different. However, when either of these differences occur, the string around one of the axle segments within one of the grooves 13 will have become completely unwound before the string on the other segment has become unwound. This causes torque to be applied to the axle at the bottom of the yo-yo's vertical motion. This can cause gyroscopic precession of the yo-yo body 7 about its vertical axis. The swivel system 5 helps to avoid raveling or tangling of the two string segments about each other when this occurs. The swivel system 5 also aids in removing such tanglings when they do occur.

The string 11 may be comprised of a variety of elongated material. However, the inventor has discovered that limp, braided string is particularly well adapted for use in connection with the present invention. A conventional yo-yo string is laid, i.e., it has strands twisted about each other in one direction. While such a conventional yo-yo string can be utilized in connection with the present invention, it may lead to some difficulties. For example, during the operation of the yo-yo, the two string segments may come into contact and twist around each other. When using a conventional yo-yo string, when this tangling occurs, there is a strong preferential tendency for the twisting to continue in the direction which causes unwinding of the twists in the original laid string. This makes it more difficult to untangle the string. This propensity towards twisting in one particular direction does not exist with a non-laid string.

It should be further pointed out that monofilament nylon can be utilized. However, monofilament nylon has a tendency to snap. Very limp, braided nylon has been found to be very effective when used in connection with the present invention. Another useful feature of the limp, braided string in connection with the present invention is the ability of the two string portions to readily slide over each other when twisted around each other. Th braided nylon achieves a very satisfactory result in this regard. Accordingly, the use of such a string facilitates the re-establishment of proper yo-yo operation if the two strings happen to become twisted about each other.

It should be noted that the present invention can be constructed with or without the arms 18 which support the loop member 17. The protective loop member 17 can be attached to, and lie below, the pulley or pulleys 1. The loop 17 limits the extent of upward travel of the yo-yo body 7. This avoids the possibility of the string being knocked out of the pulley trough 14 when the yo-yo body rises sufficiently high. The string can also be prevented from being knocked out of the pulley trough 14 by placing a loop around the pulley 1, rather than below it.

When the yo-yo reaches its high point during operation, there is a tendency for the string to be knocked off the trough 14 when the overall dimensions are such that the horizontal distance between the two string segments 11 increases from top to bottom as shown within FIG. 1. The protective ring 17 prevents this from occurring. When the horizontal distance between the two string segments 11 decreases from top to bottom, as illustrated within FIG. 4, there is little or no tendency for the string to be knocked off the pulley 1 by the body of the yo-yo 7. Accordingly, the need for the protective loop 17 is minimized or eliminated by utilizing a pulley or pulleys which separates the string segments 11 to a greater extent than they are separated by their attachment to the axle 12. The considerations are valid whether the pulley system contains one or more pulleys.

It is possible to fabricate the body of the yo-yo 7 and the pulley 1 from a variety of materials, such as wood; plastic, metal; etc. The body 7 of the yo-yo could be fabricated in various ways. For example, it could be molded as one complete unit, or the discs and axle portions could be made separately and then fastened together by various means, including but not limited to gluing; screwing; wedging; soldering; welding; etc.

The instant invention is shown and described herein in what is considered to be the most practical, and preferred, embodiments. It is recognized, however, that departures may be made therefrom which are within the scope of the invention, and that obvious modifications will occur to one skilled in the art.

I claim:

1. A toy capable of combined rotational motion about a horizontal axis and translational motion in a vertical direction, comprising:

an axle;

a first disc connected at a center point of said disc to said axle;

a second disc connected at a center point of said disc to said axle;

a third disc connected at a center point of said disc to said axle at a position on said axle between said first and second discs;

a string connected at one end to said axle at a point near said first disc, and connected at its other end to said axle at a point near said second disc; and a rotatably mounted support means over which said string is looped in a manner such that said string may slidably move over said rotatably mounted support means.

2. A toy capable of combined rotational motion about a horizontal axis and translational motion in a vertical direction as in claim 1, wherein said rotatably mounted support means is comprised of:

a pulley rotatably mounted on a C-shaped support.

3. A toy capable of combined rotational motion about a horizontal axis and translational motion in a vertical direction, as in claim 2, further comprising:

a swivel connected to said C-shaped support; and a ring member connected to said swivel.

4. A toy capable of combined rotational motion about a horizontal axis and translational motion in a vertical direction, as in any of claims 2, or 3 further comprising:

a support arm extending downwardly and outwardly from said rotatably mounted support means; and a loop connected to said support arm said loop being positioned in a plane normal to said pulley and being positioned below said pulley.

5. A toy capable of combined rotational motion about a horizontal axis and translational motion in a vertical direction, as in any of claims 2, or 3 further comprising:

a support arm extending outwardly from said rotatably mounted support means; and a loop connected to said support arm said loop being positioned in a plane normal to said pulley and being positioned around said pulley.

* * * * *